United States Patent [19]

Fitzgerald

[11] Patent Number: 5,076,536

[45] Date of Patent: Dec. 31, 1991

[54] CONCRETE FORM SUPPORTING BRACKET

[76] Inventor: Leonard R. Fitzgerald, 2659 Pacific Highway, Eight Mile Plains, Brisbane, Queensland 4123, Australia

[21] Appl. No.: 542,264

[22] Filed: Jun. 22, 1990

Related U.S. Application Data

[63] Continuation-in-part of Ser. No. 249,380, Sep. 26, 1988, abandoned, which is a continuation-in-part of Ser. No. 87,160, Aug. 19, 1987, Pat. No. 4,846,437.

[30] Foreign Application Priority Data

| | | | |
|---|---|---|---|
| Feb. 12, 1987 | [AU] | Australia | 68742/87 |
| Sep. 23, 1987 | [AU] | Australia | PI4596 |
| Sep. 23, 1988 | [AU] | Australia | 22807/88 |

[51] Int. Cl.[5] ..... E04G 17/14

[52] U.S. Cl. ..... 249/219.1; 249/3; 249/208; 403/108; 403/347

[58] Field of Search ..... 249/2-9, 249/14, 34, 208, 219.1; 425/59; 403/104, 108, 347, 374, 379, 393, 397; 248/156, 351, 545

[56] References Cited

U.S. PATENT DOCUMENTS

| | | | |
|---|---|---|---|
| 2,611,169 | 9/1952 | Torrelli | 249/9 |
| 3,213,978 | 10/1965 | Downes | 403/108 |
| 3,261,584 | 7/1966 | Miller | 403/108 |
| 4,695,033 | 9/1987 | Imaeda et al. | 249/189 |
| 4,846,437 | 7/1989 | Fitzgerald | 249/219.1 |

FOREIGN PATENT DOCUMENTS

| | | | |
|---|---|---|---|
| 888312 | 8/1953 | Fed. Rep. of Germany | 403/108 |
| 2343742 | 3/1975 | Fed. Rep. of Germany | 403/108 |
| 629049 | 12/1961 | Italy | 249/219.1 |

*Primary Examiner*—James C. Housel

*Attorney, Agent, or Firm*—Aquilino & Welsh

[57] ABSTRACT

A form supporting bracket for supporting a concrete form including an upright form supporting member, a lower prop leg connected to the upright member, an upper prop leg connected to the upright member at one end and a slidable member at its other end. The slidable member cooperates with the lower prop leg to slide therealong and includes a plurality of angle slots which mate with a plurality of oppositely angled slots on the lower prop leg. The angle slots are selectively fixed relative to one another by an elongated member which can be driven into the ground.

13 Claims, 12 Drawing Sheets

FIG. 7
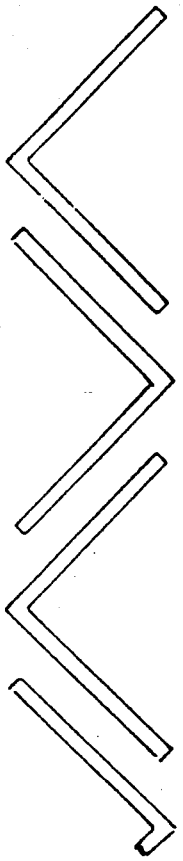
FIG. 9
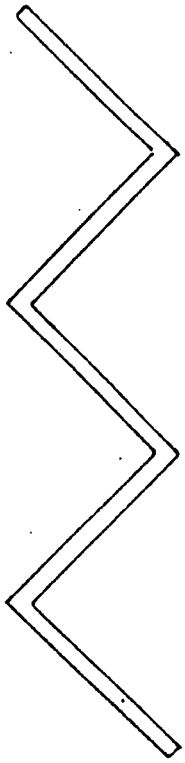
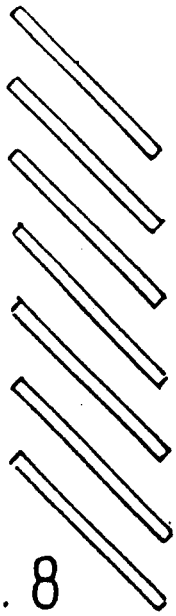
FIG. 8
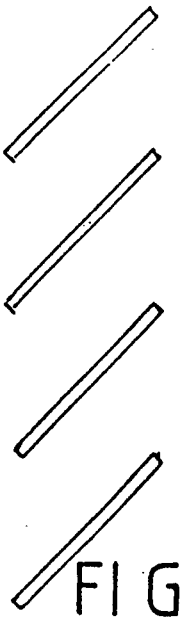
FIG. 10

CONCRETE FORM SUPPORTING BRACKET

This application is a continuation-in-part of application entitled "Lipped Channel Formwork", Ser. No. 07/249,380, filed Sept. 26, 1988, and now abandoned, which is a continuation-in-part of patent application entitled "Bracket For Supporting Concrete Formwork", Ser. No. 07/087,160 filed Aug. 19, 1987, and now U.S. Pat. No. 4,846,437.

BACKGROUND OF THE INVENTION

Threaded fine adjustment means used in building and concrete construction equipment are often damaged by dirt and mud in threads, rough handling and necessity to smash hardened concrete off threads. In the case of the latter, if the basic adjustment means were essentially flat it could be placed on a concrete slab or suitable piece of steel and cleaned with concrete-breaking equipment. An object of the basic invention is the provision of a passive, heavy-duty, essentially flat adjustment mechanism, more or less capable of being cleaned as described, or, when necessary, of being field-renovated with a hammer, without appreciable loss of function. Other and further objects of this invention, not the least of which is preservation of timber, will be pointed out hereinafter or will be indicated in the appended claims or will be obvious to one skilled in the art upon an understanding of the present disclosure.

SUMMARY OF THE INVENTION

The main object has been achieved in practice by varied application of a principle which, in the simplest case, is embodied in a method of positional adjustment of an object connected to a slidingly mobile plate, the face of the latter being held against the face of a stationary fixed plate during both movement and stopped phases of said adjustment by juxtaposing means wherein movement of said mobile plate is constrained by constraining means whereby a point on said plate describes a more or less reproducible path on said stationary plate, and along said path in the stationary plate, one or more of a series of elongated slots is provided, the latter being inclined to, and intersecting said path, and along the projection of said path on the mobile plate is provided one or more of a series of elongate slots, the latter being inclined to, and intersecting said path and more or less diagonally opposed to, and of similar width to each slot of said series of slots in the stationary plate, and the arrangement of length of, alignment of, and distance between adjacent slots within each series ensures both long sides of at least one of said slots in the stationary plate series are overlapping both long sides of at least one of said slots in the slidingly mobile plate series throughout the required range of adjustment, and therefore at any point throughout said required range of adjustment and centred on said overlap, is provided a window through both plates and thereinto may be housed a peg, the cross-sectional area and length thereof being sufficient to deny appreciable sliding of said mobile plate relative to said stationary plate.

BRIEF DESCRIPTION OF DRAWINGS

Particular embodiments of the invention shall be described with reference to the accompanying drawings in which:

FIGS. 7, 8, 9 and 10 show some of the many patterns of slotting suited to various application and method of manufacture of the theoretical device shown in FIG. 5.

DETAILED DESCRIPTION OF DRAWINGS

Figures 1, 2:
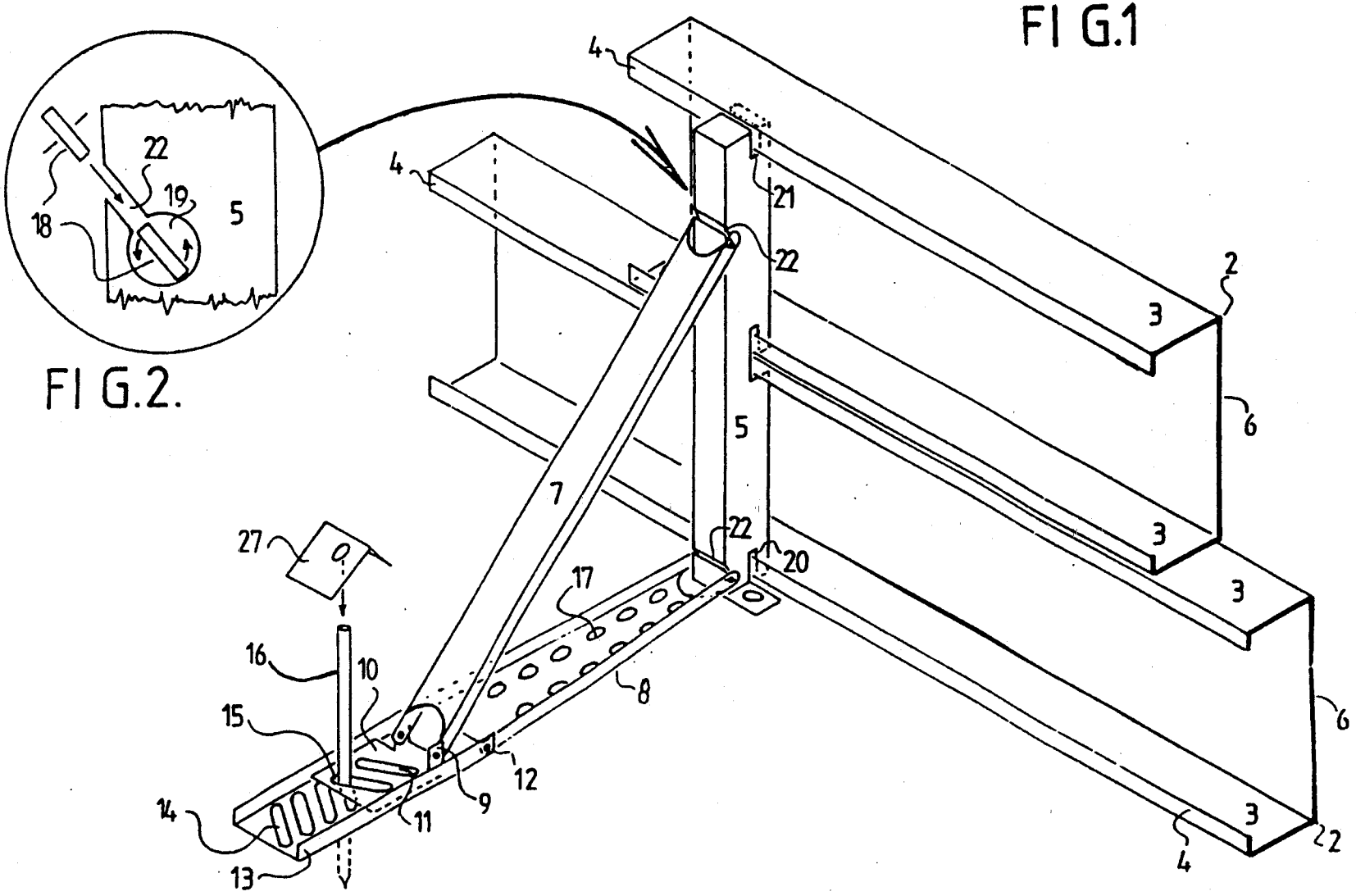
FIG. 1 shows a pictorial view of a pair of vertically (flange to flange) stacked lipped channel forms held together, engaged and supported by a rotating actioned, flange locking stud, which is in turn supported by upper and lower prop legs incorporating an adjustable sole plate, the latter being a reduction to practice of this invention.
FIG. 2 shows a sectional elevation of a particular type of quickly reversible engagement means of joining prop legs to stud.

Referring to FIG. 1, lipped channel form units 2 are shown engaged and supported at their flanges 3 and lips 4 by a support stud 5 whereby web face(s) 6 may act as casting mould for concrete or the like. In this particular embodiment, stud 5 is of unit construction with engagement means to channel lips 4 and flanges 3 and engagement means to upper prop leg 7 and lower prop leg 8, machined or moulded or cast into the stud body. Upper prop leg 7 is attached by swivel means 9 to a slideably adjustable part 10 containing slots 11 non-parallel and non-right angular orientation to either axis of channel forms or axis of formwork supports. In this particular embodiment, lower prop leg 8 is attached by swivel means 12 to a channel 13 allowing slideable part 10 to nest or house. Slideable part 10 may be channeled, thereby providing flanges for attachment of prop leg 7 and prop leg 8 may be one piece with channel 13 which contains slots 14 more or less opposed to slots 10. Other patterns of slots finding use in particular applications of the support mechanism are shown in FIGS. 7, 8, 9 and 10. FIG. 1 shows a particular application of the theoretical mechanism or principle shown in FIG. 5 whereby adjustment for plumb on form faces 6 is provided by sliding upper slotted part 10 over lower slotted part 13 until suitable relationship between upper and lower prop legs and form face is achieved. A hole or 'window' as shown in FIG. 6 is available by virtue of opposed slots and when a peg, plug, bolt or ground fixing stake 16 is inserted through the available hole or holes 15 the mechanism locks itself and slides no more. Where heavy vibration and the like is encountered the peg, plug, bolt or other fixing 16 may be splined or contain flats or the like, thereby providing further resistance to slippage especially where edges of slots are serrated or otherwise mated with the inserted part 16.

Holes 17 in lower prop leg 8 allow for positioning of ground fixing stakes to suit site requirements. Hole(s) may also be provided in lug(s) at base of support stud 5 to suit particular site conditions and applications.

Figure 3:
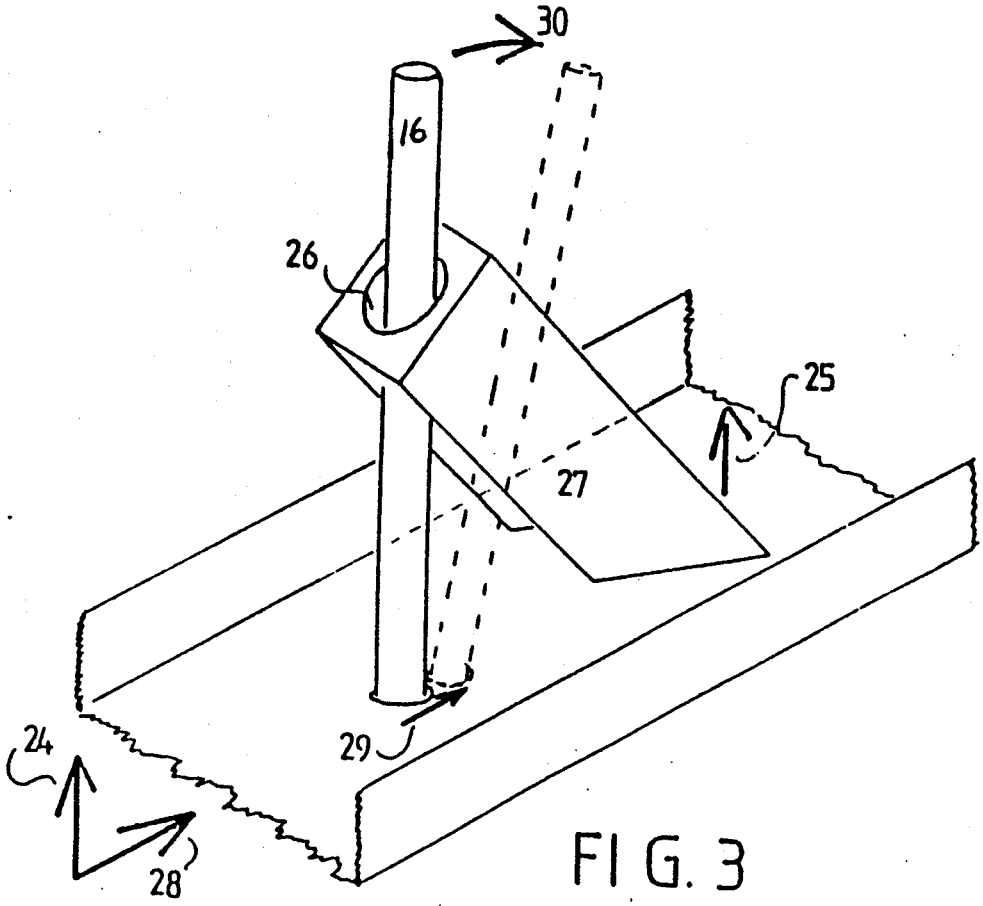
FIG. 3 shows a pictorial view of an anti-lift, anti-roll device fitted to a ground fixing stake.

Part of a stud, 5, is shown in FIG. 2. Flattened engagement piece 18 may be formed from prop material or be a flattened bolt or the like. Double receptor holes 19 may be formed at end of lip engaging slots 20 and 21 whereby said slots perform similar function to entry slots 22.

Where stud 5 is solid (GRP for example), holes 19 are continuous. A gussetted anti-lift and anti-roll device 27 shown in FIG. 3 is fitted to a ground fixing spike 16 passing through one of holes 17 or where necessary, 15. During placement and vibration, concrete, acting as an imperfect fluid, tends to lift or float formwork and/or formwork supports. Arrows 24 show approximate direction of this force, which, transmitted through the formwork members acts to lift lower prop leg approximately according to arrows 25 in FIGS. 3 and 4.

The edges of hole 26 in anti-lift device (27) function to jam or lock on to ground fixing spike 16 causing friction between the lower part of spike and subgrade to react the flotation force of the fluid concrete. Hydrostatic or head pressure of fluid concrete plus pressure developed by immersion vibrators acts approximately according to arrows 28 and is transmitted through formwork members according to arrows 29 causing tendency of pegs to move or roll according to arrows 30 about a pivot point in the subgrade below, whereby, as shown in FIG. 3 during support failure, a small movement of prop leg 8 causes a large rolling movement of ground fixing stake 16 to new position 31 (broken line) and beyond. Function of anti-roll device 27 and tension rod 32 is partly to counteract said rolling movement of ground fixing stake 16 and force said stake to remain substantially vertical whereby it can react a far greater load than would otherwise be the case. Put simply, the force required to push ground fixing stake 16 through the subgrade in the manner of a ripper or plough, is far greater than that required to push top part of stake over. Thus the mode of action of anti-lift, anti-roll device is partially causing flotation pressure 24 to ..ct against head of concrete and/or vibration pressure 28.

Figure 4:
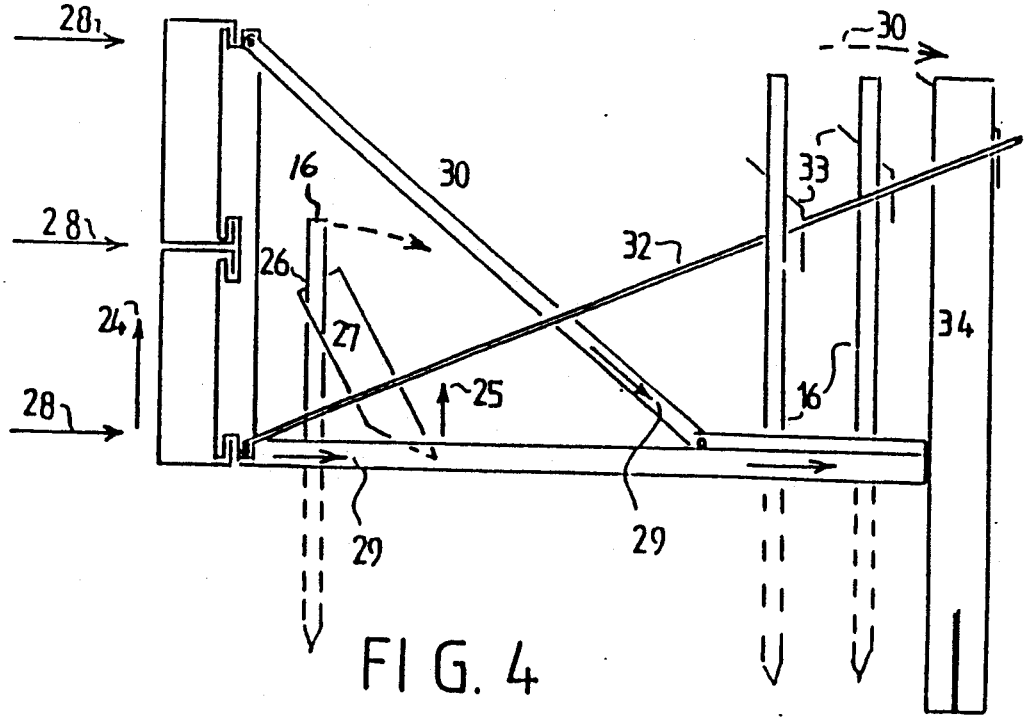
FIG. 4 shows a diagrammatic representation of lipped channel forms and formwork support system to illustrate forces acting during concrete placement and the means by which they are reacted.

Tension rod 32 is fixed to stud or lower prop leg or both as shown in FIG. 4 and acts via self-tightening adjustable means 33 attached to rod 32 ground fixing stakes 16 and to heavy duty ground spike 34.

Figure 5:
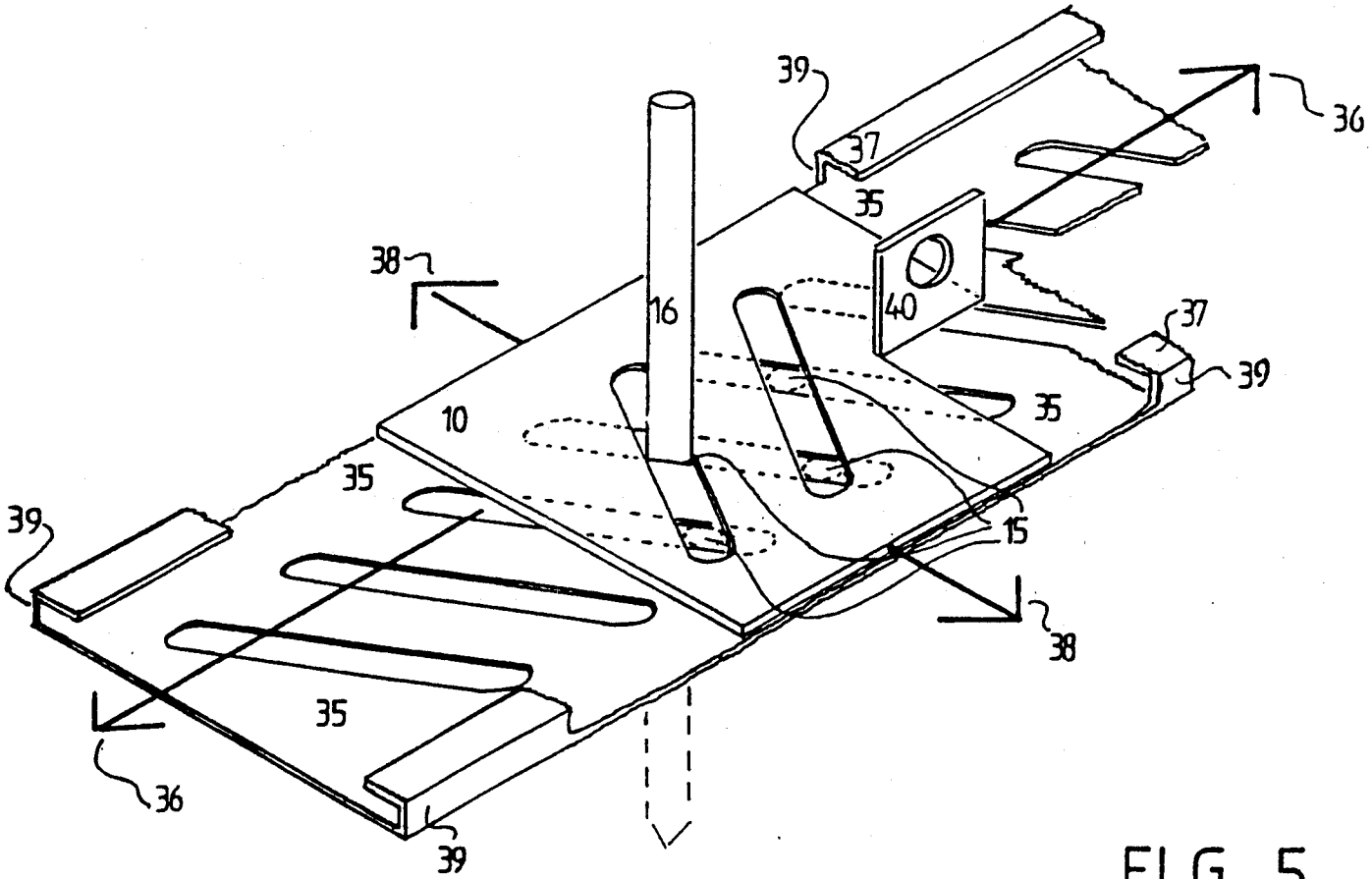
FIG. 5 shows a pictorial, partly cut-away view of a locking, passive, fine-adjustment mechanism demonstrating the constraint on degrees of freedom and the principle by which it acts.
Figure 6:
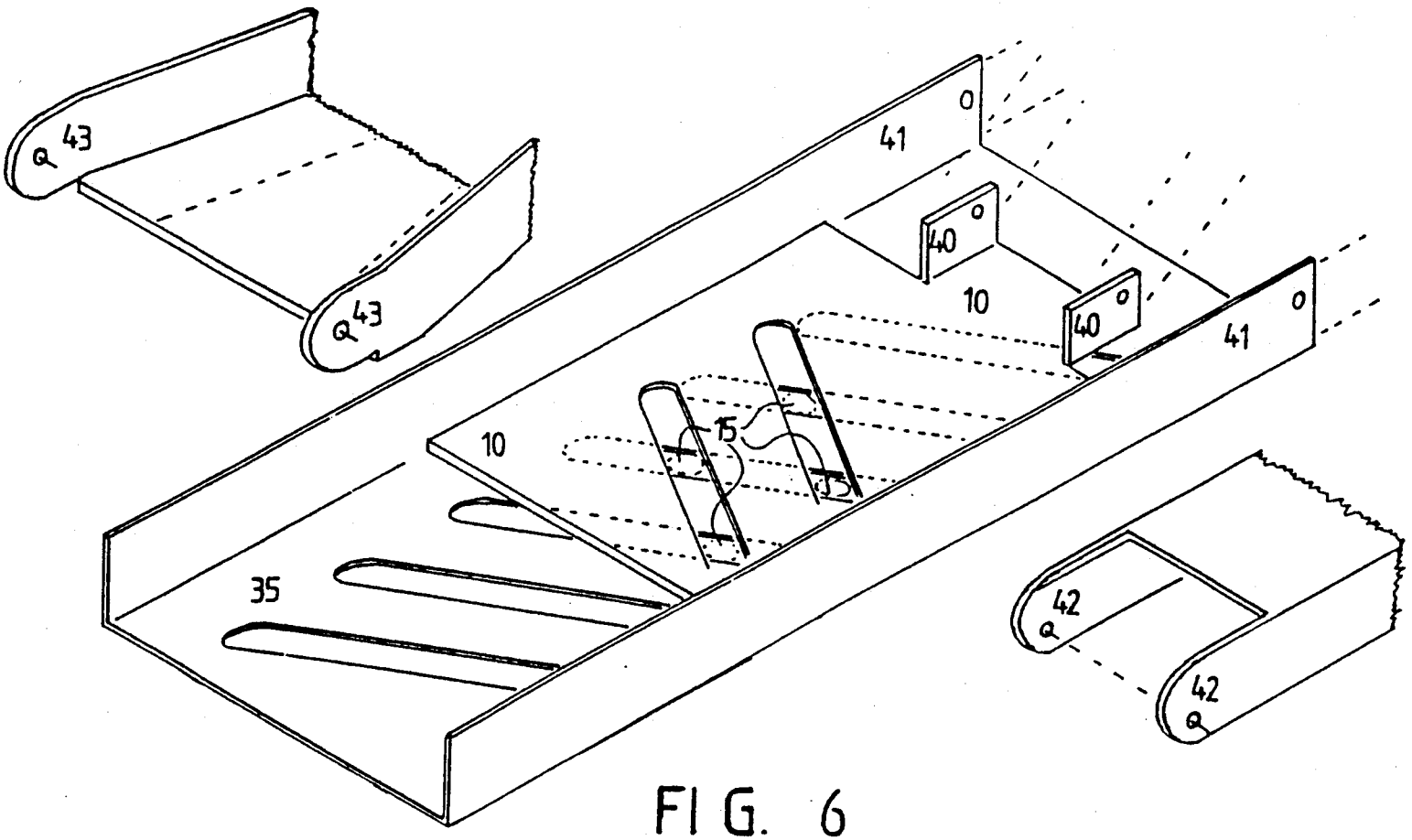
FIG. 6 shows a pictorial (exploded) view of a particular (formwork sole plate) application of the theoretical fine-adjust mechanism shown in the previous figure.

The principle of action of sliding a fine adjust device whose application as adjustable sole plate, is shown in FIG. 5 whereby movement of plate 10 carrying diagonal slots is restricted to movement along underlying lipped channel 35 according to heavy arrows 36.

Side movement according to arrows 38 is denied by virtue of channel flanges 39 and, in this case, lip 37 (flange and lip shown cut away in region of slideable upper plate for viewing purposes. As upper slotted plate 10 slides along lower slotted channel 35, windows 15 through both plates are uncovered whereby there is always one or more windows through which a fixing means 16 stopping further movement may be inserted. A lug or lugs 40 containing hole(s) serves as a connecting means to upper prop leg 7 whose position is being adjusted. An embodiment more suited to formwork sole plate application is shown in FIG. 6, an exploded view showing lugs 40 and attachment means 40 and 41 to connect with upper prop leg attachment means 42 and lower prop leg attachment means 43, respectively.

Another embodiment (not shown) uses channel as the upper sliding plate 10 whereby the flanges of the channel provide attachment means to whatever implement needs to be fixed in position. Other systems include square and rectangular box sections and the like which, when nested, find use as props. The principle of opposed slots in mating surfaces is not limited to linear movement or adjustment between parts, but may be applied to circular motion wherein the requisite constraint between rotating arms or plates is provided by a fixed pinning means (rivet or bolt or the like). The invention resides broadly where two or more surfaces may move relative to each other but such movement is constrained thereby causing a point on one surface to describe a more or less reproducible path on another surface whereby surfaces movement may be locked or fixed by insertion of a pin or pins at any point where a 'window' is provided by a slot or pattern of slots cut in one surface (or material) crosses a more or less diagonally opposed slot or pattern or slots cut in the other surface or material. Some patterns of slots are provided by illustrative purpose only, in FIGS. 7, 8, 9 and 10. These slot patterns are not meant to be exhaustive; for example, slots must be modified to cross a radial pattern where a non-linear motion must be arrested at a given point as occurs in safety positioning of an excavator boom during service, or the adjustment of angle between the seat and back support of a chair or lounge.

Where vibration is encountered, fixing pins 16 may be splined or contain flats or other configurations to match edges of said slots. Although discrete diagonal slots as shown in FIGS. 8 and 10 work well, certain other effects or phenomena exist which make other patterns suitable for particular applications. For example, under exceeding loads, pins tend to move toward and/or away from the centre line of the pattern shown in FIG. 7 allowing fitment of a separate connecting or locking device or means (not shown) between slot pins thereby extending the safe working load (SWL) or extending failure point.

Figure 11:
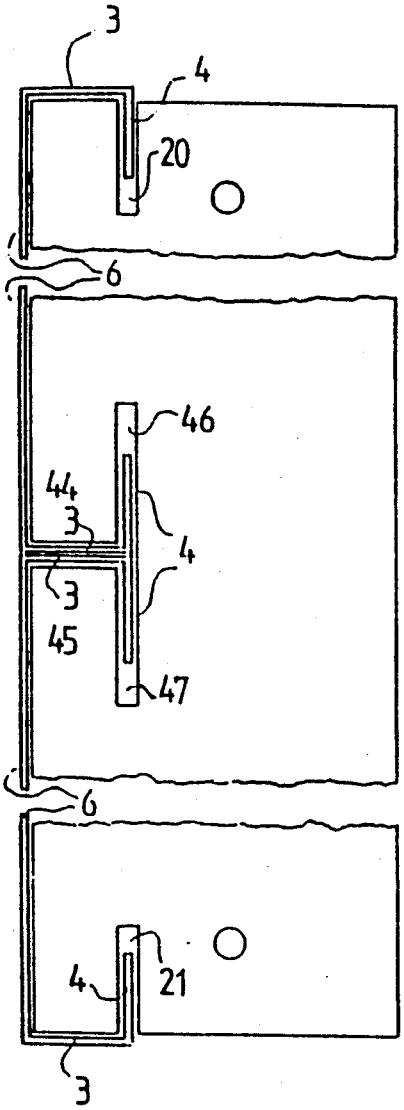
FIG. 11 shows a height-shortened schematic part elevation of a variation of the dual channel single-action support stud shown in FIG. 1.
Figure 12:
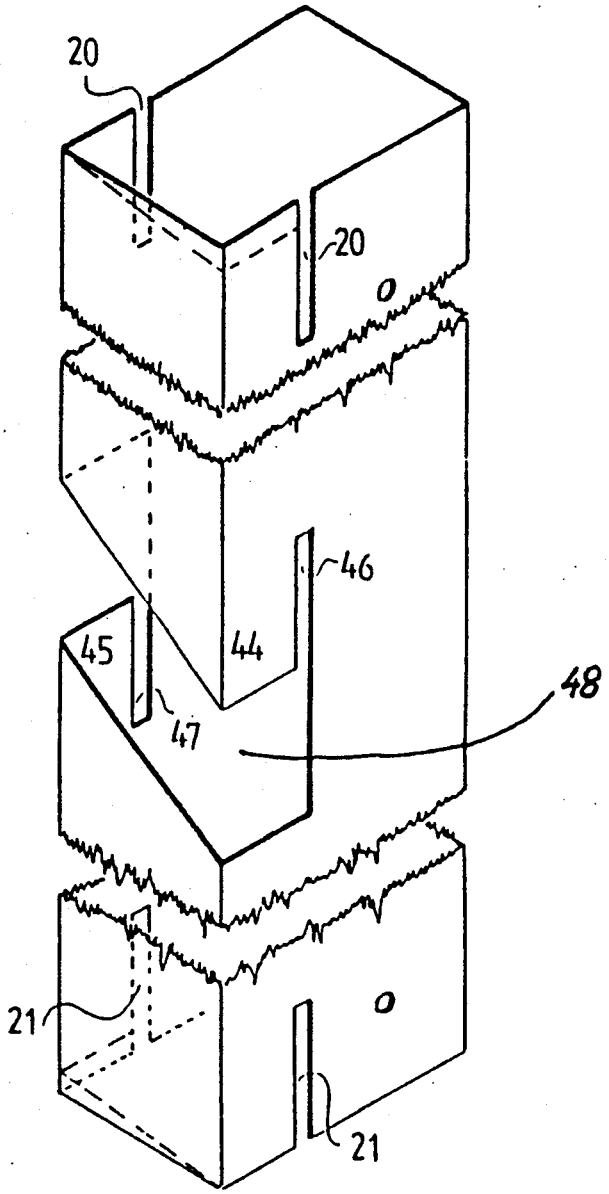
FIG. 12 shows a pictorial-diagrammatic view of the representation of the support stud shown in the previous figure.
Figure 14:
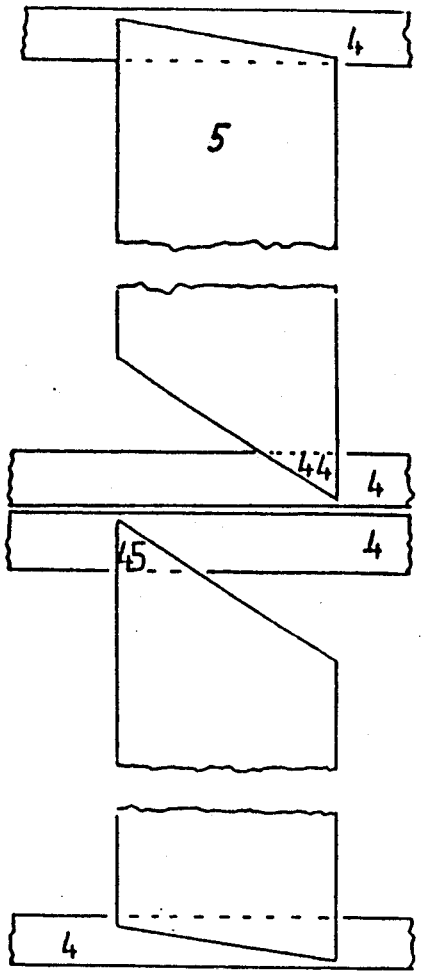
FIGS. 13 and 14 show diagrammatic elevations of the support stud shown in FIGS. 11 and 12 viewed from the cast concrete through transparent channel webs in order to demonstrate the lip engagement method of action of the particular embodiment of support stud shown in the previous two figures.
Figure 13:
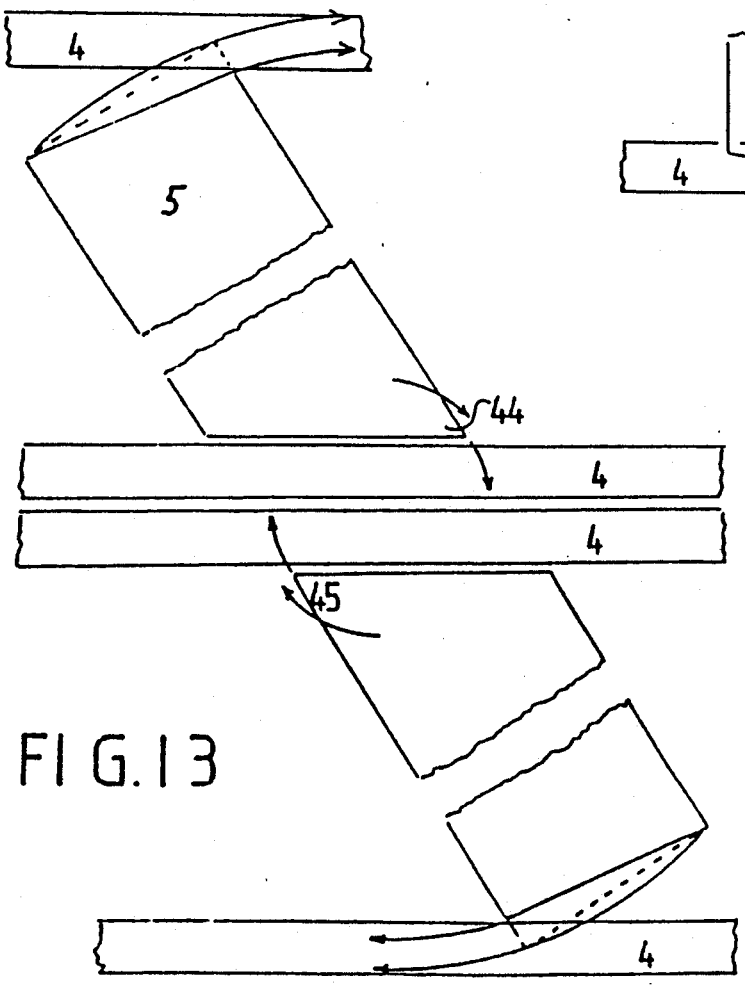

Support stud 5 is shown in diagrammatic (height shortened) elevation in FIG. 11 and pictorially in FIG. 12. Central lip retaining lugs 44 and 45 are machined from or moulded into stud 5, leaving a diagonal cut-out 48. The lips 4 of the two forms are housed in slots 46 and 47 and 20 and 21. During assembly the forms are placed side by side (flange butted to flange) and diagonal cut out 48 is placed over adjoining form channel lips 4 as shown in FIG. 13, then rotated according to arrows to position the forms at right angles to the stud 5. This rotating action causes lips 4 to be housed in slots 20, 21, 46 and 47. Although this particular embodiment of support stud 5 is probably more expensive to manufacture than one piece studs with lip retaining lugs welded thereon, this type of stud will be likely to handle rough treatment better (lip retaining lugs are less likely to break off or be lost) and should give longer service life.

Figure 15:
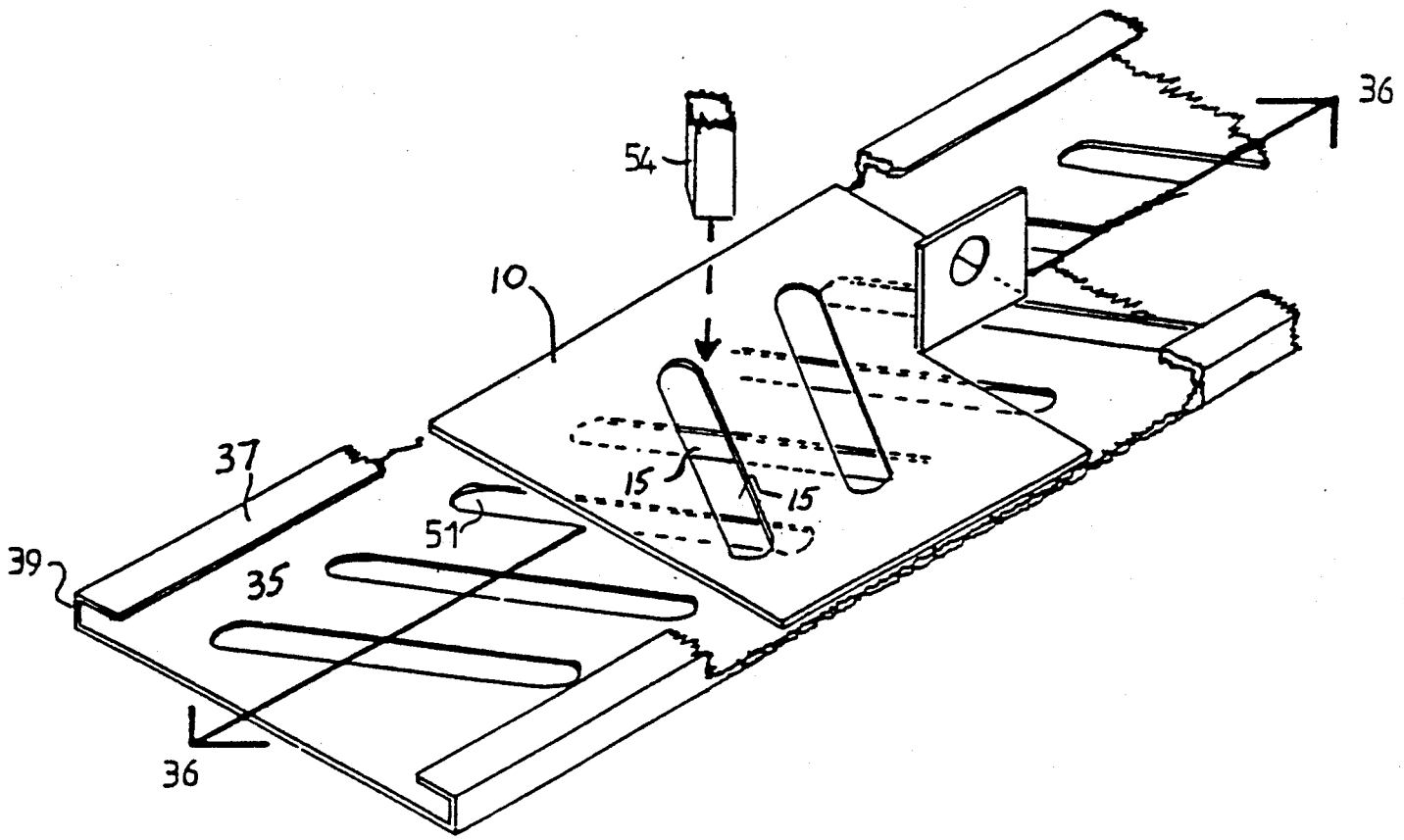
FIG. 15 is a cutaway pictorial view showing a diamond-shaped peg for housing in a slot window.

The assembly of FIG. 15 is similar to FIG. 5 but shows the use of a diamond-shaped peg 54 instead of a stake 16.

Figure 16:
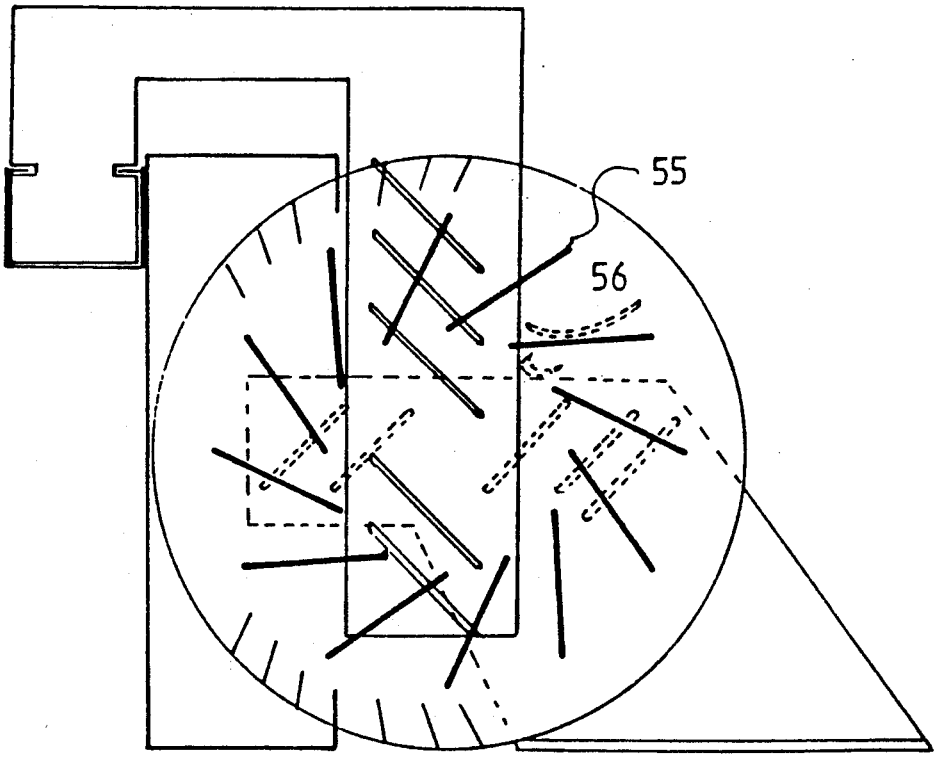
FIG. 16 shows a side elevation of turbine-like arrangement of slots for non-linear paths.

FIG. 16 shows an arrangement having slots 55 in the circular segment 56 in order to suit non-linear path dependent upon positioning of pinning means.

Figure 17:
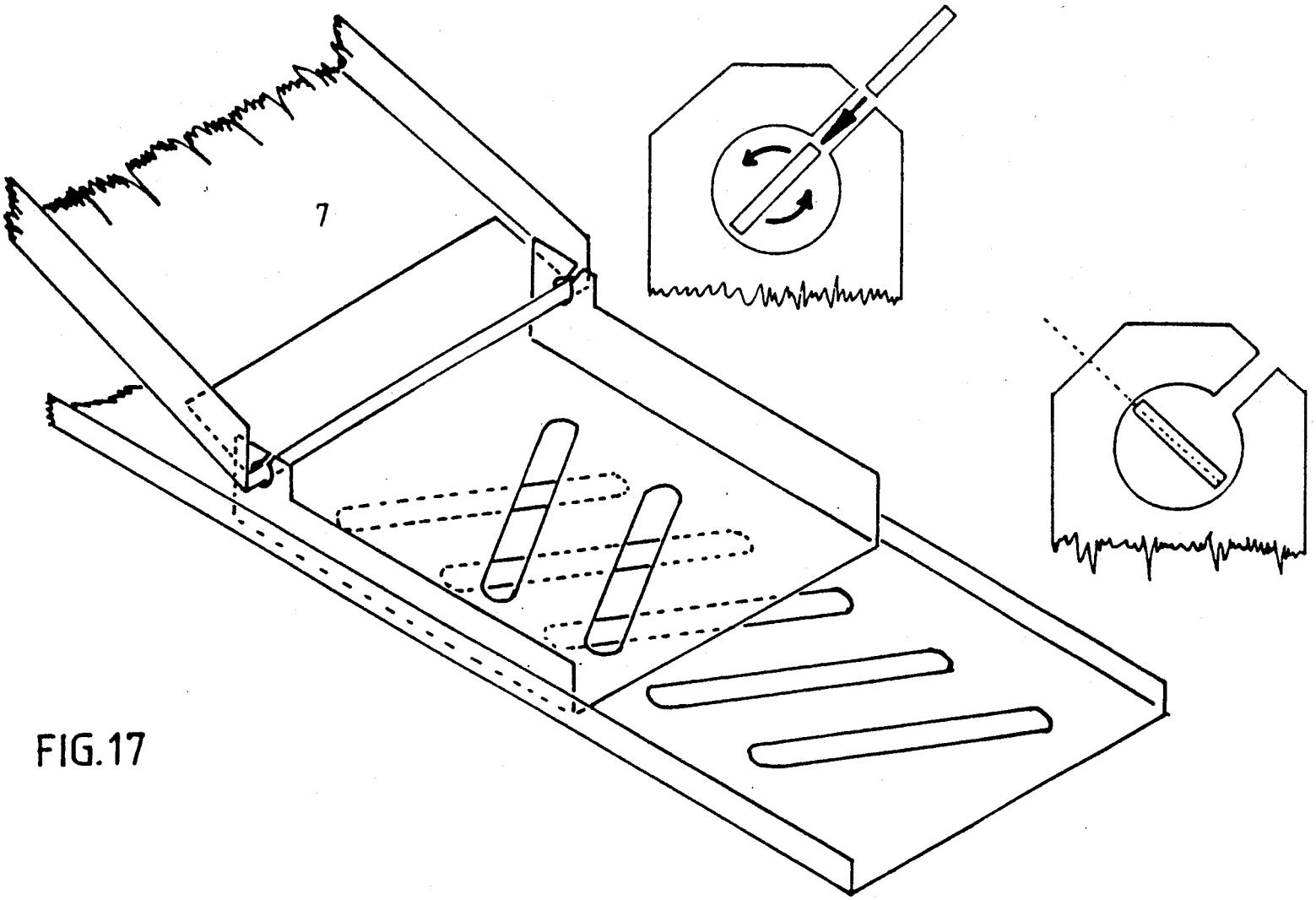
FIG. 17 shows a pictorial view of channel used as both stationary and mobile plates in a sole plate assembly suited to shoring and formwork seen in the following figure. (Insets show one way slot method off quick release connection to sole plate).
Figure 18:
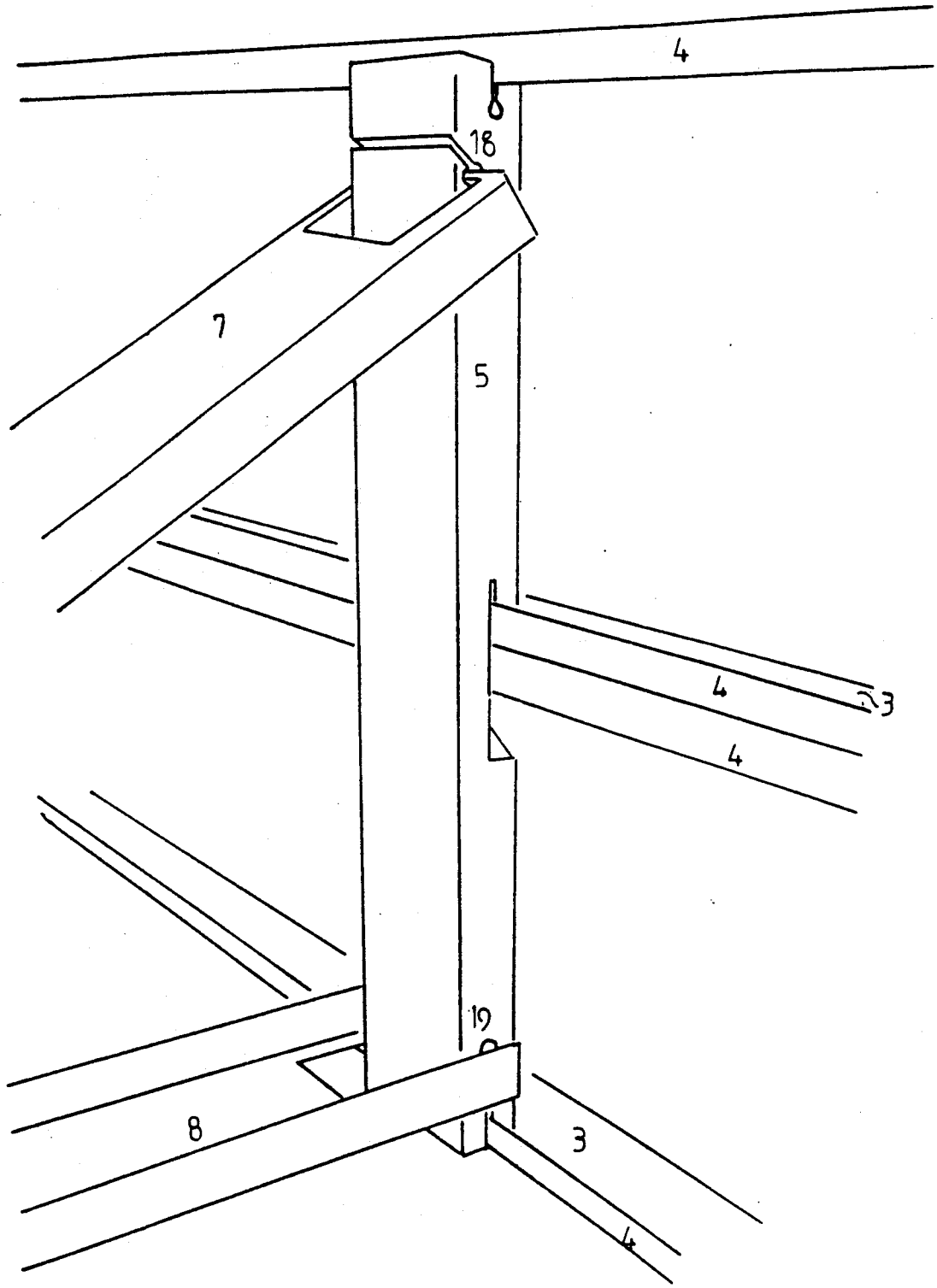
FIG. 18 shows a pictorial view of formwork equipment shored in practice by adjustable sole plate of this invention.

In FIGS. 17 and 18 is shown practical application of an adjustment assembly wherein the juxtaposing means is provided by gravity during adjustment and (after adjustment) by gravity and clamp 27 the latter also acting to stop lifting or floating of the whole assembly and rolling failure of ground fixing spike 23 as shown in FIG. 4. Constraining means in FIG. 17 is provided by matching deformation of lateral edges of both plates said deformation being in the form of channel lips in this example.

Figure 19:
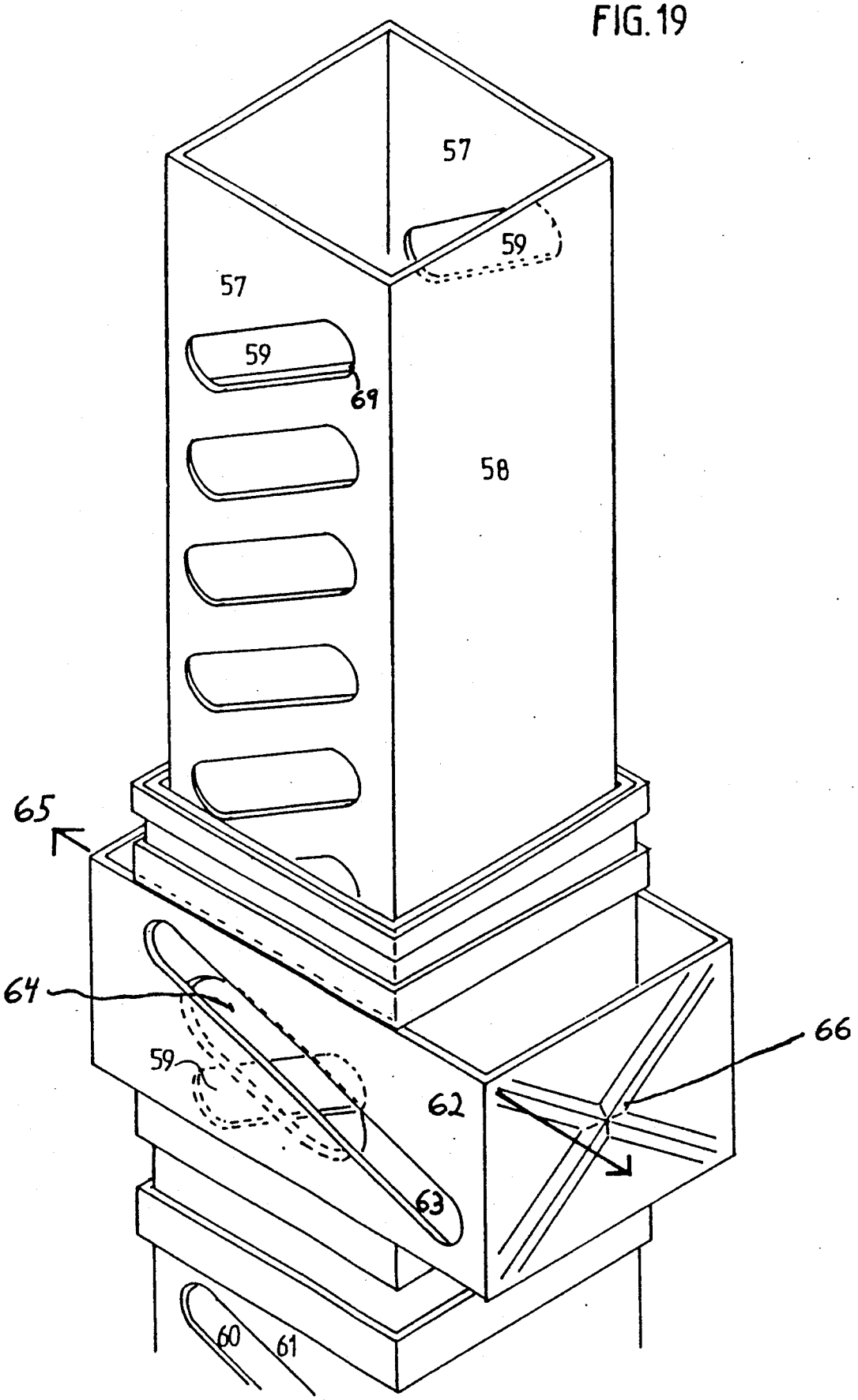
FIG. 19 shows a pictorial view of nested Rectangular Hollow Section (R.H.S.) tube showing arrangement of parallel slots in opposing webs, captive mobile slot carrier and housings for a removable jacking device (the latter not shown).

FIG. 19 shows an adjustment assembly which is a modification of the basic invention wherein each of the plates containing a particular series of slots is duplicated in opposing webs of nesting Rectangular Hollow Section (R.H.S.) tube whereby the slots 59 in said opposing webs 57 of the smaller tube 58 are parallel and virtually identical in size, shape and orientation but more or less diagonally opposed to the slots 60 in opposing webs 61 of the larger tube. A captive mobile slot carrier 62 allows "shimming up" of inserted peg by lateral movement of mobile slots 63 acting as double sided wedges on peg or pin inserted through enlarged slots 64 in opposing webs 61. Arrows 65 show movement of said carrier 62 which is strengthened 66 where it may be struck by a hammer during assembly release.

Housings 67 for a removable jacking device (not shown) act to retain mobile slot carrier and strengthen mouth of outer tube 68. Preferably material removed to form slots 59 in inner tube is folded inward 69 to strengthen slotted web. These nested tubes when provided with base plates at top of inner tube and bottom of outer tube, may be used as passive propping or shoring assemblies to structures capable of carrying their own weight after curing such as cast-in-situ concrete decks, with mobile slot carrier allowing stripping out. However an aim of this design work is to provide active fine adjustment (without threads) continuously throughout most of the possible range of variation of length of the prop assembly. It is proposed that a cost-effective method of achieving this object is to allow the jacking means to be separable from the prop assembly once the variation in prop length—under load—and placement of the fixing pin(s) has been completed. According to this concept, each jacking means is merely a tool inserted or attached onto the prop assembly when prop length variation under load is necessary, thereby allowing each jacking tool to serve between one and a hundred props rather than the case with the most common example of the prior art, where the jacking means is integral with the prop assembly. In this manner, the cost of a more elegant, capable and expensive jacking tool may be amortized across a large number of simple prop assemblies. Further, with current equipment, damage to the integral jacking means may cause the prop assembly to be unusable and vice-versa. By separating the jacking function from the propping function, damage to the one does not necessarily render the other inoperative, thus lowering the potential cost and inconvenience of said damage.

The following discussion of "see-saw" methods by which active fine adjustment under load may be achieved (without using threaded systems as the prime mechanism in the jacking tool) is intended to show that the concept of a removable jacking tool is practical. In interests of brevity of this application, one jacking method is discussed in order to illustrate the concept, but is not meant to be exhaustive of the field.

In the "see-saw" example of a prop jacking tool, said tool assembly is separate from, but quickly connectible to the top portion of said outer RHS prop tube. Said jacking tools "walks" said slotted inner RHS tube out of, or into (depending on whether lengthening or shortening of overall prop assembly is required) said outer tube via a see-saw action of a pair of pivoting lever arms operating on opposite slotted webs of said inner RHS tube. Once the quick-fit connection between jacking tool and prop outer tube is made, the distance between said lever arms' pivot-point and top of said outer tube is fixed. Operation of a propulsion arm causes said lever arms to operate in a see-sawing action, whereby operating pins connected to end portions of lever arms engage and act on said more or less diagonal slots in said inner tubes' webs causing inner tube to move either into, or out of said outer tube depending upon the setting of the operating pins. In this particular extension of the invention, the propulsion arm is fixed to said lever arms and is operated in a manner similar to that of a car jack or Tirfor winch. The first and last part of the more or less semi-circular path described by the operator's end of the propulsion handle is translated (via ramped, mating surfaces on operating pins and said pin housings located distally from the said pivot point on each said lever arm) into more or less orthogonal to RHS wall linear motion of operating pins in order to engage or disengage said pins where appropriate with or from said diagonal slots formed in inner prop tubes' webs. For savety reasons, said ramp-induced, initial more or less linear pin engagement-disengagement orthogonal to planar path or propulsion handle, is preferably backed up by tension springs and/or "over-cnetre" link-bar operated concurrently and appropriately by first and last motion of said propulsion handle.

More simply, in this particular extension of the concept, only the central quadrant of the propulsion arms' travel is used to change position of props' inner tube relative to props' outer tube. The rest of said propulsion arms travel (first movement and last movement or ends of the more or less semi-circular path) is used to engage/disengage appropriate pins with/from said inner tubes more or less diagonal slots.

The function of said fixing pin(s) which are fitted transversely through the prop assembly (via "windows" caused by said diagonally opposed slots of said inner and outer prop tubes criss-crossing) is to lock the required relative position of said prop tubes and allow said jacking tool to be removed after the requisite prop length is reached. Because of necessary working clearances of said jacking tool and to facilitate removal of said fixing pin(s) at the completion of the job it is proposed that a "shimming-up" effect be obtained. In order to illuminate this concept, it is proposed that a suitably positioned pair of slots near the top of said outer prop tube are preferably made oversize, thereby allowing fitment of a mobile, angled slot acting more or less as a captive wedge to "shim up" the assembly in a releasable manner. In other words, in some applications it is preferable that the slot edges acting on said fixing pin need not be monolithic with said outer tube but may be moved (by striking laterally with a hammer) causing said fixing pin to move both longitudinally and laterally (relative to prop assembly) to a "drum-tight" position thereby removing working clearances. When prop function has been completed, jacking tool is attached to prop assembly and when ready, said "mobile angled slot" is tapped in lateral release direction, giving working clearances for said jacking tools' operating pins to engage said more or less diagonal slots of said inner tube. At this point with said operating pins safely carrying the load, said fixing pin may be removed more easily. To ease understanding and by way of illustration, imagine that said "mobile angled slot" is contained in a short captive length of RHS (fitted over the top of said outer tube) with slight clearance to slotted webs of said outer tube but large clearances (taken up by captive rotating wedges) to said outer tubes' unslotted webs. Said captive RHS is then free to move laterally (when required) causing the resultant mobile slot to perform proposed function.

What is claimed is:

1. A form supporting bracket for supporting a concrete form on a support surface, said bracket comprising an upright support member engaging and holding said form, an elongated stationary lower prop leg extending outwardly from and pivotally attached to said form support member at a lower end thereof, an upper prop leg extending outwardly from and pivotally attached to said form support member at a point above said lower end, a slidable member pivotally attached to the upper prop leg at an end thereof opposite said form support member which slides along the length of the lower prop leg, said lower prop leg and said slidable member each having at least one acutely angled elongated slot therein, said slot in said lower prop leg being acutely angled relative thereto in a direction substantially opposite to the acute angling of the slot in the slidable member, and a fixing means cooperating with the slots when selectively aligned for fixing the slidable member relative to the lower prop leg.

2. A form supporting bracket of claim 1 wherein said lower prop leg includes a means for laterally constraining the sliding movement of said slidable member along the lower prop leg.

3. A form supporting bracket of claim 1, wherein said fixing means further includes a means for clamping the slidable member against the lower prop leg.

4. A form supporting bracket of claim 2, wherein said lower prop leg includes a longitudinal channel section having a slotted web and a pair of upturned flanges, and said slidable member sliding against said web, whereby said flanges are said constraining means.

5. A form supporting bracket of claim 4, wherein each of said flanges includes a lip spaced from said web, said lips extending toward each other.

6. A form supporting bracket of claim 4, wherein said slidable member is a slidable channel section having a slotted web and a pair of upturned flanges, said slidable channel section being nested in said channel section of said lower prop leg, whereby said flanges are said constraining means.

7. A form supporting bracket of claim 1, wherein said lower prop leg includes a tubular section, each slot therein having a transversely aligned identically angled slot on said tubular section, and said slidable member is a slidable tubular section nested over said tubular section of said lower prop leg, each said slot in said slidable tubular section having a transversely aligned identically angled slot on said slidable tubular section.

8. A form supporting bracket of claim 1, wherein said lower prop leg includes a plurality of identically angled slots, and said slidable member includes a plurality of identically angled slots angled substantially opposite to said slots in said lower prop leg.

9. A form supporting bracket of claim 1, wherein said lower prop leg and said slidable member each include at least one additional slot acutely angled oppositely to said at least one slot therein.

10. A form supporting bracket of claim 1, wherein at least one of said pivotal attachments comprises a flattened pivot piece attached to one of said legs, said pivot piece being rotatably received in a receptor hole provided in one of said members, said hole having an entry slot opening to an edge of one of said members through which said pivot pin may be inserted and removed for quick assembly and disassembly of the bracket.

11. A form supporting bracket of claim 1, wherein said lower prop includes a first section pivotally attached at a first end thereof to the support member, and a second section pivotally attached at one end thereof to a second end of the first section, said first section including at least one hole therein in which a ground stake is received, and said second section including said at least one slot therein.

12. A form supporting bracket of claim 1, wherein the pivotal attachments of said lower and upper prop leg to said form support member are removable.

13. A form supporting bracket of claim 1, wherein said fixing means comprises an elongated element.

* * * * *